United States Patent [19]

Holtkamp

[11] 4,214,224

[45] Jul. 22, 1980

[54] MULTI-FUNCTION SELF-CLEANING OVEN THERMOSTAT

[75] Inventor: Calvin J. Holtkamp, Mansfield, Ohio

[73] Assignee: White Consolidated Industries, Inc., Cleveland, Ohio

[21] Appl. No.: 945,399

[22] Filed: Sep. 25, 1978

[51] Int. Cl.[2] ..... H01H 37/36

[52] U.S. Cl. ..... 337/323; 337/115; 337/312; 337/316; 337/319

[58] Field of Search ..... 337/323, 312, 313, 316, 337/319, 115, 330; 219/412, 413, 489

[56] References Cited

U.S. PATENT DOCUMENTS

| | | | |
|---|---|---|---|
| 3,648,012 | 3/1972 | Holtkamp | 337/312 X |
| 3,680,021 | 7/1972 | Holtkamp | 337/312 |
| 3,752,954 | 8/1973 | Holtkamp | 219/413 |
| 3,891,957 | 6/1975 | Holtkamp | 337/319 X |
| 4,075,593 | 2/1978 | Beck | 337/312 |

*Primary Examiner*—R. L. Moses

*Attorney, Agent, or Firm*—Pearne, Gordon, Sessions, McCoy & Granger

[57] ABSTRACT

A multi-function, pyrolytic self-cleaning oven thermostat for regulating bake and clean temperatures and oven door unlatching. The thermostat includes separate bistable and creep-action switch mechanisms actuated by a single thermally expansive hydraulic wafer responsive to oven temperature changes. An axially movable partially threaded shaft, rotatable between two end positions, is provided for operator adjustment of the temperature switching point of the bistable mechanism. At one end position of the rotative shaft a minimum baking temperature switching point is provided while at the other end position a maximum temperature switching point is established for pyrolytic self-cleaning of the oven. A generally linearly increasing temperature range of bistable mechanism switching points is provided from the minimum to the maximum temperature switching point end positions. A portion of the temperature range not suitable for baking or pyrolytic cleaning and corresponding to a sector of shaft rotation between the two end positions may be utilized as an off position separating a larger sector of baking temperature shaft positions and a smaller self-cleaning shaft position sector. The maximum temperature switching point end position is adjustable to facilitate clean temperature calibration. The creep action switch mechanism is utilized during a self-cleaning operation to preclude oven door unlatching above a predetermined temperature.

11 Claims, 5 Drawing Figures

MULTI-FUNCTION SELF-CLEANING OVEN THERMOSTAT

CROSS-REFERENCE TO RELATED PATENTS

My U.S. Pat. Nos. 3,648,012, 3,680,021, 3,752,954 and 3,891,957 are considered to be related patents and are herein incorporated by reference in their entireties.

BACKGROUND OF THE INVENTION

The present invention is directed in general to a temperature controller for a pyrolytic self-cleaning cooking oven and in particular to a multi-function oven thermostat which provides both bake temperature regulation and pyrolytic cleaning temperature regulation in response to a single temperature sensor.

Many prior art pyrolytic self-cleaning ovens utilize separate oven temperature sensors and corresponding sensor responsive thermostats for independent regulation of baking temperatures (approximately 100°-500° F.) and of a pyrolytic cleaning temperature (about 850° F.). The use of a single oven temperature sensor thermally responsive over a range including both bake temperature and a pyrolytic cleaning temperature requires that the corresponding sensor responsive thermostat provide means for its calibration to both a range of baking temperatures and to a self-cleaning pyrolytic temperature. Such means for calibration should be provided in a simple and reliable manner.

SUMMARY OF THE INVENTION

In accordance with the invention, a shaft, rotatable for angular displacement between two end positions, provides operator adjustment of an electrical switching means which for example regulates both bake temperatures and pyrolytic cleaning temperature in a self-cleaning oven. The electrical switching means is actuated by a single sensor responsive to oven temperature changes. The range of shaft rotation corresponds to and directly determines a generally linearly increasing range of oven temperatures which includes at least baking temperatures and a pyrolytic cleaning temperature. At least one of two stop tabs defining the rotative shaft end positions is movably adjustable to advantageously vary the range of shaft rotation and thus the limits of the range of oven temperatures. Such a feature is particularly useful for providing a calibrated pyrolytic cleaning temperature at the shaft end position defined by the adjustably movable stop tab.

DETAILED DESCRIPTION OF THE PREFERRED EMBODIMENT

Figure 1:
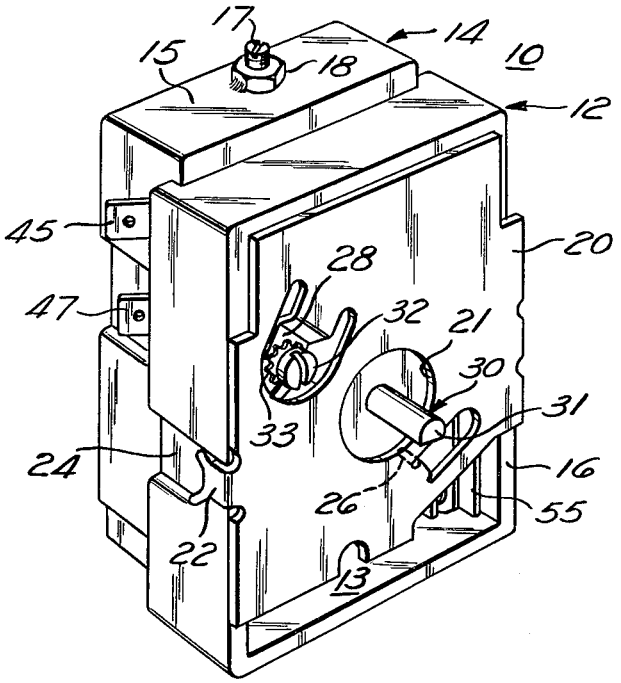
FIG. 1 is a perspective view of a multi-function oven thermostat in accordance with the present invention.

Turning to FIG. 1, there is illustrated in accordance with the invention a multi-function oven thermostat including a generally rectangular-shaped housing 10 which is preferably formed of molded electrical insulating material such a phenolic resin or a like plastic composition. The housing 10 includes a front rectangular section 12 and a rear rectangular section 14. The front section 12 includes a wall 16 which extends rectangularly to define the periphery of the front section 12. The forwardly facing end of the front section 12 defined by the peripherally extending wall 16 is generally closed by a front cover 20 which snaps onto the front section 12 by means of a pair of snap-fitting tongues 22 (only one shown) which engage snap tongue retention cavities 24 (only one shown) integrally molded within the side faces of the front section 12 of the housing 10. The cover 20 is sized to provide a narrow transversely extending opening 13 along the bottom of the front section 12, such opening 13 permitting limited access to the interior of the housing 10, the purpose of such access opening 13 to be explained subsequently.

The rear rectangular housing section 14 includes on its upper surface 15 means for adjusting the thermostat to a selected calibration bake temperature. The adjusting means preferably takes the form of a screw member 17 which extends through the upper surface 15 into the interior of the housing 10 in a manner to be more fully illustrated. The screw member 17 threadingly engages a nut 18 which is anchored by appropriate adhesive or other mechanical means to the upper surface 15.

The front cover 20 of the control includes a generally centrally located shaft aperture defined by a circular wall 21. Projecting outwardly from the interior of the control through the aperture defined by the circular wall 21 is a control shaft 30 having a hemispherical cross section end portion 31 as illustrated. The end portion 31 of the shaft 30 extends generally perpendicularly relative to the cover 20 into the interior of the housing 10. The front cover 20 further includes a first stop tab 26 which extends into the housing interior and lies along an axis generally parallel to the longitudinal axis of the shaft 30. The front cover 20 further includes a locking screw mount 28 which projects inwardly and then horizontally to the cover 20 and threadingly receives through an appropriate aperture a second stop tab locking screw 32 and a lock washer 33 in a manner and for a purpose to be subsequently disclosed. Both the first stop tab 26 and the locking screw mount 28 are provided by appropriate metal punching and deformation of the front cover 20.

With the thermostat of the present invention in a conventional mounted condition relative to a pyrolytic self-cleaning range control panel, the front cover 20 is placed against the back face of the control panel with the control shaft 30 extending through an aperture in the control panel for reception of an operator accessible control knob. The control knob includes, for example, an index or pointer which follows a range of temperatures and functions scaled on the face of the control panel. Such control panel faces and control knobs are well known in the art and therefore are not illustrated.

In operation, the shaft 30 can be turned clockwise until its shaft rotation is limited by the stop tab 26. At this far right end position, the thermostat provides and maintains a low bake temperature of approximately 120°-140° F. As the control is rotated counterclockwise from its right end position defined by stop tab 26 an increasing range of baking temperatures is provided to approximately 500° F. Further counterclockwise rotation of the shaft to a far left end position which is provided in a manner to be subsequently illustrated provides a cleaning temperataure of approximately 850° F. The sector of shaft rotation between approximately 500° F. and the cleaning temperature of 850° F. can be utilized as an off position for the oven in a manner to be subsequently explained. Thus, in accordance with the invention, temperature regulation is provided via a single control shaft for both baking temperatures and clean temperature regulation. The degree of shaft rotation is limited in angular displacement to less than one revolution by the two end positions defined in the clockwise direction by stop tab 26 and defined in the counterclockwise direction by a second stop tab to be subsequently illustrated. In a preferred form of the invention, the second stop tab defining the counterclockwise end position is adjustable to permit calibration of the control for a specified clean temperature of 850° F., the locking screw 32 and washer 33 engageable with the mount 28 providing means for locking the second counterclockwise shaft revolution stop tab at the desired calibration position.

Figure 2:
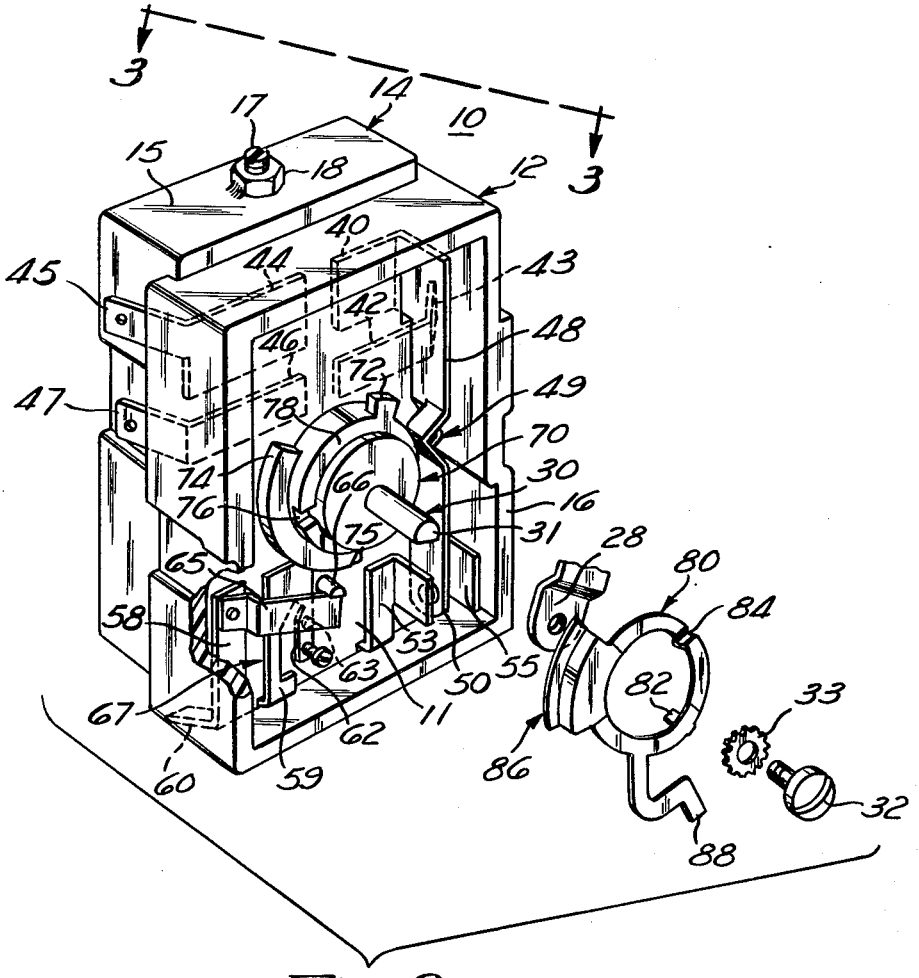
FIG. 2 is a partially exploded, perspective front view of the oven thermostat with a portion of its front cover cut away.

With reference to FIG. 2, the interior of the front section 12 of the housing 10 is more clearly illustrated with certain elements being illustrated in an exploded view manner. The housing 10 includes within its rear section 14 a plurality of fixed and movable electrical contacts 40,42,44,46 (portions illustrated schematically). In particular, a first fixed set of parallel oven heating element control contacts 40,42 are fixed to the rearwardly facing side 19 (See FIG. 5) an intermediate wall 11 which divides the interior volume of the housing 10. Adjacent to the oven heating elements contacts 40,42 are a fixed set of parallel oven pilot light contacts 44,46 also within the rear section 14 fixed to the rearwardly facing side 19 (FIG. 5) of the intermediate wall 11. The contacts 42,44,46 extend to associated external terminals 43,45,47 (See FIG. 3 for element 47) for electrical connection into the electrical wiring system of the oven. Electrical bridging of the contacts 44,46 actuates, for example, an oven pilot light, while contemporaneous electrical bridging of the contacts 40,42 would thermally regulate the oven by turning "on" and "off" the oven heating elements such as baking and broiling elements. The fixed contact 40 electrically extends through the wall 11 into the front section 12 of the housing 10 and then to the exterior of the housing 10 via a leaf type spring member 48 which includes a cam follower section 49. The distal end 50 of the spring member 48 includes a pair of opposed contacts 52,54 (See FIG. 4). The contact carrying distal end 50 of the spring member 48 is capable of oscillation between a fixed bake mode contact 53 and a fixed clean mode contact 55, the leaf spring distal end 50 being biased normally toward and in electrical contact with the bake contact 53 when the cam follower section 49 is not engaged with a cam surface to be subsequently illustrated. The contacts 53,55 extend to external terminals 56,57 as illustrated in FIG. 4 for connection with the range wiring circuitry.

Figure 4:
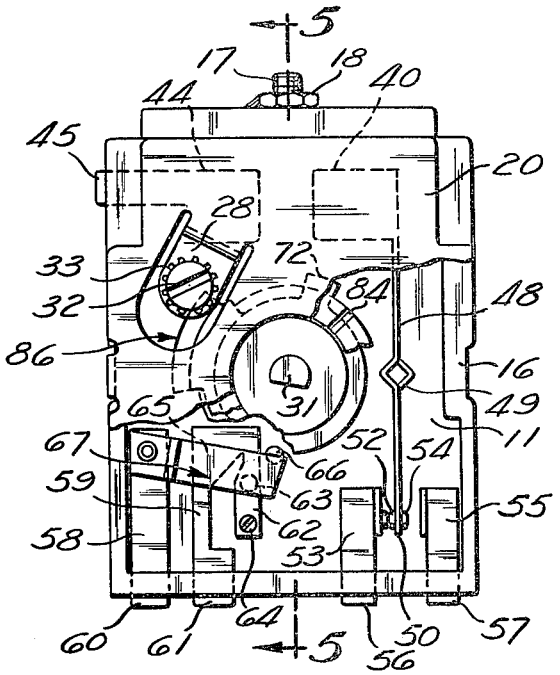
FIG. 4 is a front elevation view of the thermostat with portions cut away.

As illustrated in FIGS. 2 and 4, the housing front section 12 further includes a creep-action switch mechanism 67 preferably in the form of a pair of door unlatching interlock contacts 58,59 which are fixed to the housing. The contacts 58,59 extend to external terminals 60,61 as illustrated in FIG. 4. A portion 62 of the contact 59 contains a contact 63 and is adjustably movable by means of a door interlock switch temperature adjustment screw 64 which is used to calibrate the creep action switch for electrical opening at an approximate oven temperature of 500° F. Electrical bridging between the contacts 58,59 is accomplished by a metallic leaf 65 which extends from the contact 58 over to the contact 59 and is movable to and away from the contact 59 by means of a movable pin member 66 in order to provide open and closed circuit conditions between external contacts 60,61 (FIG. 4). The exact operation of the switch will be subsequently illustrated.

As further illustrated in FIG. 2, a generally cylinder-shaped stop lug element 70 fits onto the hemispherical cross section rotary shaft end portion 31 and is rotatably lockable thereon wherein the shaft 30 and the element 70 rotate together. The stop lug element 70 includes an integral stop lug 72 projecting radially from the longitudinal axis of the shaft 30. The stop lug element 70 further includes a camming surface 74 extending radially and partially about the outer cylindrical surface of the stop lug element 70. The stop lug element 70 further includes a detent receptacle or slot 76 which opens toward the front cover 20 (FIG. 1). The stop lug element 70 as illustrated in FIG. 2 is rotatably set at a position providing a moderate baking temperature of about 300°–350° F. Rotation of the shaft 30 in a clockwise direction concurrently rotates the stop lug element 70 until the integral stop lug 72 engages the first stop tab 26 provided by the cover 20 as earlier noted with regard to FIG. 1. At this far clockwise end position, the control is set for a minimum baking temperature. The camming surface 74 does not engage the cam follower section 49 of the spring member 48 so that continuity from contact 40 through bake mode contact 53 is maintained. Upon counterclockwise rotation of the shaft 30, the stop lug 72 moves away from the first stop tab 26 and at a prescribed degree of counterclockwise shaft rotation the camming surface leading edge 75 engages the cam follower section 49 of the spring member 48 so as to move the spring member distal end 50 away from contact 53 and against contact 55 to establish electrical continuity between contact 40 and 55. Under these conditions, the thermostat is set to regulate high temperature within the oven for pyrolytic self-cleaning. It should be noted that an additional camming surface could be provided which, upon engaging the cam follower 49, would center the distal end 50 (FIG. 4) between the contacts 53,55. Such additional camming surface would constitute means for providing an "off" position of the shaft 30 as earlier explained. To calibrate the thermostat for a cleaning temperature of approximately 850° F. the stop lug 72 is arrested during a calibration precedure at a counterclockwise end position which maintains an oven temperature of 850° F. Means for adjustably moving or maintaining the calibrated counterclockwise end position of the rotatable shaft 30 preferably include an annular ringlike member 80 (FIG. 2) which provides a second stop tab 82 extending inwardly so as to lie in the plane of rotation of the stop lug 72. The ringlike member 80 further includes a detent projection 84 and a locking flange 86. The inner diameter of the ringlike member 80 is approximately sized to fit over and abut an annular flange portion 78 of the stop lug element 70. The ringlike member 80 is not flat, but rather is slightly distorted or wave-like and is formed of resilient spring-like material. The cover 20 is placed on and fastened to the housing 10 wherein the ringlike member 80 is sandwiched between the cover 20 and the stop lug element 70, the wave-shaped, ringlike member 80 being compressed to function as a hold down spring maintaining the axial position of the stop lug element 70 on the shaft 30. Upon counterclockwise rotation of the shaft 30 and its associated stop lug 72, the stop lug 72 eventually engages the second stop tab 82 provided by the ringlike member 80. At this position, the detent projection 84 of the ringlike element 80 engages the detent receptacle 76 of the stop lug element 70 so as to provide releasable locking of the rotary shaft 30. This releasable locking advantageously occurs at the clean position of the thermostat and provides operator "feel" of such clean setting and precludes slipping of the rotary shaft out of position during a cleaning cycle.

To calibrate the control for an upper limit clean temperature of approximately 850° F. one merely rotates the ring member to the desired end position which in turn moves the second stop tab 82 for partial circular revolution about the axis of rotation of the shaft 30. Such rotation is accomplished by movement of an adjustment arm 88 accessable by access opening 13 (FIG. 1). When the position of the second stop tab for a calibrated temperature of 850° F. is established, the stop tab 82 is locked in position by anchoring of the screw 32 (FIG. 1) which holds the locking flange 86 in place against the mount 28. Thus, the shaft 30 is rotatable for angular displacement between two end positions defined by the first stop tab 26 provided by the cover 20 and the second stob tab 82 provided by the ringlike member 80.

Figure 3:
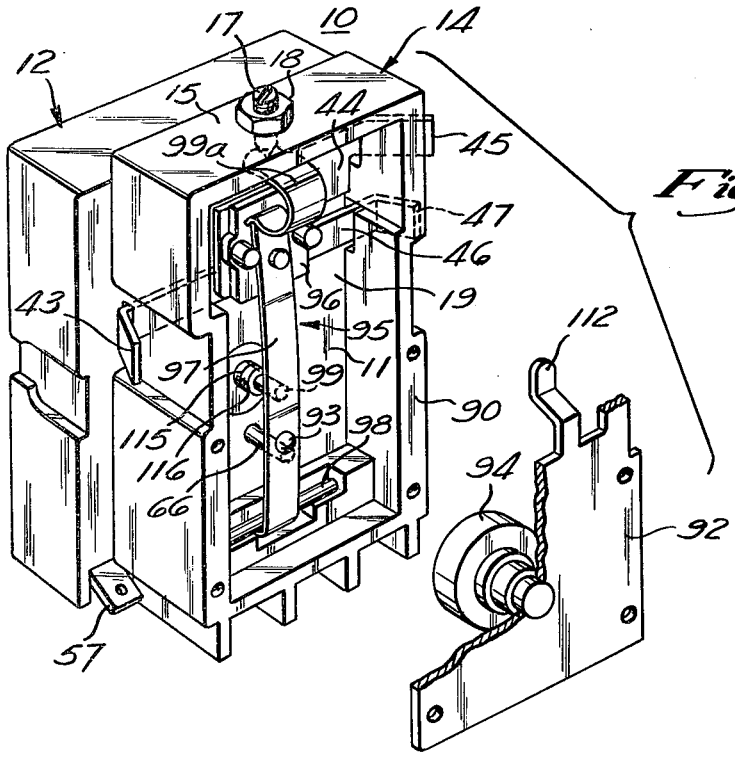
FIG. 3, taken along line 3—3 of FIG. 2, is a partially exploded, perspective rear view of the oven thermostat with a portion of its back cover cut away.

Turning to FIG. 3, the thermostat of the present invention includes the back housing section 14 defined by a generally rectangularly extending back wall 90 to which is fastened a cover 92 (only a portion being shown). Mounted to the cover 92 for enclosure in the housing 10 is a thermally expansive hydraulic wafer 94 of the sodium potassium eutectic alloy (NaK) type responsive over a baking and cleaning temperature containing range of approximately 100°-900° F. In a conventional manner, a capillary tube (not shown) extends from and is in fluid communication with the interior of the wafer 94. The distal end of the tube projects into the interior of the oven to be temperature regulated. Heating of the distal end of the capillary tube within the oven causes expansion of the eutectic metal mixture contained therein such expansion being transmitted to wafer 94 which in turn expands it metal diaphragm in a conventional manner for actuation of a bistable switch 95 mounted within the rear housing section 14. The bistable switch 95 is of a conventional kind as illustrated in the patents referenced and incorporated herein and includes a movable contact member 96 fixed to the distal end of a leaf spring member 97 having its other end pivoted to the housing via a dowel 98. One side of the leaf member 97 abuts the door lock switch actuating pin 66 and a switch actuating shaft end 99 within the housing rear section 14. The shaft 30 is threading engaged with a section of the housing in a manner to be subsequently illustrated wherein rotation of the shaft between its two end positions causes axial movement of the shaft actuating end 99 wherein the shaft end 99 pushes against or pulls away from the leaf spring element 97. The contact element 96 is conventional in nature and carries two bridging members which establish electrical continuity between contacts 40 and 42 and between contacts 44 and 46 as illustrated and earlier discussed with regard to FIG. 2. Snap action of the bistable mechanism is provided by an over-center spring element 99*a* whose effect on the leaf spring 97 is adjustable via the adjustment screw 17 which varies the amount of compression force supplied by the over-center spring element 99*a* to the leaf spring member 97. With the back cover 92 in position on the housing 10, the hydraulic wafer element 94 abuts the opposed side of the leaf spring member 97 at a raised dimple portion 93. Upon rising oven temperature, the wafer expands and moves towards the leaf spring 97 so as to supply a force against it. The shaft end 99 acts as a fulcrum point. At a switching point determined by the axial position of the shaft end 99, the contact member 96 snaps away from or toward the related fix contacts 40,42 and 44,46 to open and closed circuit position. By moving the fulcrum point supplied by the axially movable shaft end 99, the mechanism will switch between an open and closed condition at predetermined increments of wafer movement corresponding to a generally increasing range of oven temperature. The operation of such a switch is well known in the art and is further disclosed in the references patents herein.

The expanding wafer 94 in addition to causing the opening and closing movements of the bistable switch 95 also causes independent axial movement of the pin 66 which projects through the intermediate wall 11 (FIG. 5) which divides the housing into front and rear chambers 105 and 110 (FIG. 5) respectively.

Figure 5:
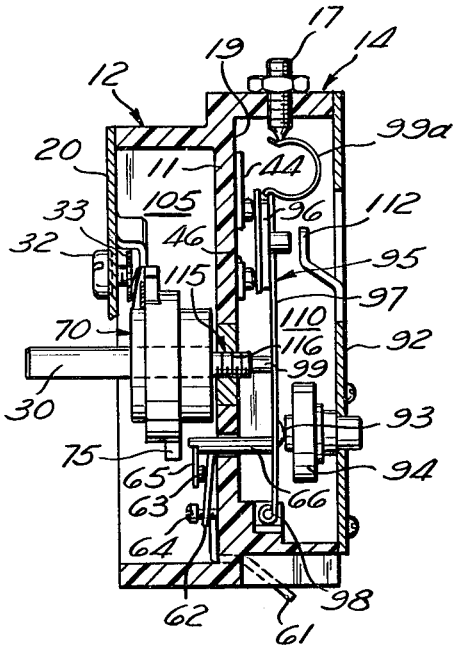
FIG. 5 is a cross-sectional elevation view of the oven control taken along line 5—5 of FIG. 4.

With reference to FIG. 5, expansion of the hydraulic wafer 94 as explained with regard to FIG. 3 causes movement of the pin 66 against the movable leaf spring element 65 of the door lock creep action type switch 67 wherein the contact 60 opens to effectively preclude unlatching of the oven door in a known manner. Calibration of the door lock switch opening at 500° F. temperature is provided by an adjustment screw 64 as earlier noted.

With further reference to FIG. 5, an intermediate portion 115 of the shaft 30 is at least partially threaded for threadingly engaging a respective threaded bore 116 extending through the intermediate wall 11. Preferably, the bore 116 is a threaded metal bushing press fitted into an appropriate aperture in the wall 11.

With further reference to FIG. 5, snap-action of the contact carrier 96 is limited in one direction by the fixed contacts 40,42,44,46. Snap action in the opposed direction is limited by a pair of stops 112 (only one shown) provided by the back cover 92.

It can be seen that the single sensor thermostat in accordance with the invention functions to regulate both baking temperature and cleaning temperature while additionally providing a door lock switch. With reference to FIG. 5, for a fixed dial position in the bake temperature range such as 400° F. the control is calibrated for opening and closing of the bistable switch by appropriate rotation of the adjusting screw 17. With the shaft rotated to its far counterclockwise position, the control is calibrated for a 850° F. clean temperature by rotation of the second stop tab containing ring member 80 is earlier explained. Calibration of the door lock switch for opening at 500° F. is provided by adjustment of the door interlock screw 62.

The thermostat of the present invention advantageously provides the numerous noted temperature control functions in a simple and direct manner with high reliability and low cost.

Although a preferred embodiment of this invention has been shown and described, it should be understood that various modifications and rearrangements of the parts may be resorted to without departing from the scope of the invention as disclosed and claimed herein.

What is claimed is:

1. A thermostat suitable for the control of a pyrolytic, self-cleaning oven comprising:

a housing;

an axially movable shaft mounted on the housing and rotatable for angular displacement between two end positions, an increment of shaft axial movement being in response to and directly related to an increment of shaft rotational movement;

an electrical switch means having a switching point adjustable in response to axial movement of the shaft;

an element movable in response to changing temperature, the movable element actuating the electrical switch means between open and closed conditions at a switching point determined by the axial position of the shaft; and means for relocating at least one end position for adjustably limiting the range of angular displacement of the shaft between the two end positions so as to limit the range of shaft axial movement and therefore determine the range of switching points.

2. A thermostat according to claim 1 wherein the end positions are defined by stop tabs fixed relative to the housing, at least one of the stop tabs being movably adjustable for oven control calibration purposes, the shaft including a radially extending projection separately abutting each of the stop tabs when the shaft is rotated to each of its respective two end positions.

3. A thermostat according to claim 2 wherein the movably adjustable stop tab is capable of partial circular revolution about the axis of rotation of the shaft, the adjustable stop tab being lockable at any position within its sector of partial circular revolution.

4. A thermostat suitable for the control of a pyrolytic, self-cleaning oven comprising:

a housing having an interior volume divided by an intermediate wall, the divided housing defining a first chamber and a second chamber, the intermediate wall including a threaded wall bore extending generally perpendicularly through the intermediate housing wall;

a shaft extending through the threaded wall bore, an intermediate portion of the shaft being threaded, the threaded shaft portion threadingly engaging the corresponding threaded wall bore, rotation of the shaft causing axial movement of the shaft along its axis of rotation; the shaft including an associated stop lug located in the first chamber, the stop lug extending radially from the shaft longitudinal axis;

a bistable snap-action switch located within the second housing chamber, the bistable switch abutting an end of the shaft within the second chamber, axial movement of the shaft varying the switching point of the bistable switch;

a hydraulic wafer located in the second chamber, the wafer including a portion movable in response to changing temperature, the movable portion of the wafer abutting the bistable switch, movement of the movable wafer portion actuating the bistable switch between open and closed conditions at a switching point determined by the axial position of the shaft end abutting the bistable switch; and a pair of stop tabs located within the first chamber and engageable with the shaft stop lug to limit the range of angular displacement of the rotatable shaft to less than a complete revolution, at least one of the stop tabs being adjustable for calibration purposes to vary the range of angular displacement of the shaft so as to limit the range of axial movement of the shaft and therefore determine the range of the switching points of the bistable switch.

5. A thermostat according to claim 4 wherein the adjustable stop tab extends from a ringlike member adjacent to the shaft stop lug, the ringlike member surrounding the shaft and being rotatable about the shaft axis of rotation, the ringlike member being lockable to preclude its rotation.

6. A thermostat according to claim 4 wherein the first chamber includes an auxiliary electrical switch means actuated by the movable portion of the hydraulic wafer actuation of the auxilary electrical switch means being independent of the actuation of the bistable switch.

7. A thermostat according to claim 6 including a movable pinlike element extending through the intermediate housing wall, one end of the pinlike element abutting the electrical switch means in the first housing chamber, the other end of the pinlike element being located in the second housing chamber and moving in response to movement of the movable portion of the hydraulic wafer.

8. A thermostat suitable for the control of a pyrolytic, self-cleaning oven comprising:

a molded housing formed of electrical insulating material, the housing being divided by an intermediate wall to define front and rear chambers opening outwardly in opposed directions;

a front cover and a back cover for closing the front and rear chambers respectively;

a rotatable shaft extending generally perpendicularly through the front cover and the intermediate housing wall, the shaft communicating with the front and rear chambers of the housing, the shaft being threadingly engaged with a portion of the housing for axial movement along its longitudinal axis in response to its rotation;

a bistable snap action switch mounted on the housing within the rear chamber, the bistable switch abutting an end of the shaft within the rear chamber, axial movement of the shaft varying the switching point of the bistable switch;

a thermally responsive hydraulic wafer mounted on the back cover and located within the rear chamber, the wafer including a portion movable in response to changing temperature, the movable portion of the wafer abutting the bistable switch, movement of the movable wafer portion actuating the bistable switch between open and closed conditions at a switching point determined by the axial position of the shaft end abutting the bistable switch;

a stop lug element located in the first chamber and mounted on the shaft and rotatably movable with the shaft, the element including a stop lug projection extending radially from the shaft;

a first stop tab fixed to the front cover and extending therefrom to engage the stop lug projection and limit shaft rotation in one direction;

an annular ringlike member surrounding the shaft and sandwiched between the front cover and the stop lug element, the ringlike member being rotatable to a limited degree about the axis of rotation of the shaft;

a second stop tab extending from the ringlike element to engage the stop lug projection and limit shaft rotation in the other direction, the second stop tab being movable in response to rotation of the ringlike member wherein the range of angular displacement of shaft can be varied for calibration purposes by rotation of the ringlike member and its associated second stop tab; and means for locking the ringlike member at one rotational position subsequent to calibration.

9. A thermostat according to claim 8 wherein said stop lug element includes a camming surface engageable with an actuating circuit selector switch means located in the front chamber.

10. A thermostat according to claim 8 wherein the stop lug element includes at least one detent recepticle and wherein the ringlike member includes at least one detent projection, the recepticle and projection engaging at a rotational detent position of the shaft to releasably lock the shaft at the detent position.

11. A thermostat according to claim 8 wherein the sandwiched ringlike member is compressed between the front cover and the stop lug element, the ringlike member functioning to maintain the axial position of the stop lug element on the shaft.

* * * * *